United States Patent [19]

Mountain

[11] 3,976,401

[45] Aug. 24, 1976

[54] PUMP FOR ABRASIVE SLURRIES AND THE LIKE

[76] Inventor: Donald C. Mountain, 2812 King Road, N. Kingsville, Ohio 44068

[22] Filed: Jan. 2, 1975

[21] Appl. No.: 538,026

[52] U.S. Cl. ..... 417/393; 91/275; 417/505; 417/900

[51] Int. Cl.[2] ..... F04B 17/00; F04B 39/08; F04B 15/02; F01L 25/08

[58] Field of Search ..... 417/393, 505, 900, 46, 417/47; 91/275, 459; 259/169

[56] References Cited

UNITED STATES PATENTS

| | | | |
|---|---|---|---|
| 2,336,446 | 12/1943 | Tucker et al. | 417/46 |
| 3,128,711 | 4/1964 | Voigt et al. | 417/900 X |
| 3,279,383 | 10/1966 | Smith | 417/900 X |
| 3,319,530 | 5/1967 | Sjoberg | 91/275 |
| 3,477,380 | 11/1969 | Johanson et al. | 417/900 X |
| 3,489,063 | 1/1970 | Piret | 91/275 |
| 3,494,290 | 2/1970 | Schaible | 417/505 X |

FOREIGN PATENTS OR APPLICATIONS

| | | | |
|---|---|---|---|
| 615,571 | 2/1961 | Canada | 91/275 |

*Primary Examiner*—C. J. Husar
*Assistant Examiner*—Leonard Smith

[57] ABSTRACT

A hermetically sealed pump for abrasive slurries in which a auxilliary control takes over whenever the pump is unable to complete its stroke and causes rapid jogging reciprocation to dislodge solids which may have settled out and blocked the completion of the stroke.

6 Claims, 4 Drawing Figures

PUMP FOR ABRASIVE SLURRIES AND THE LIKE

This invention is a pump for handling abrasive slurries and other materials difficult to handle. The pump uses diaphragm pistons in hermetically sealed pumping chambers with internal electric contacts for a control which reverses the pistons at the end of each stroke.

If there is excessive delay in reversal, an auxilliary control is actuated to reverse the stroke at relatively high rates to jar any solids which may have settled out in the pumping chambers and blocked the completion of the stroke.

In the drawing

Figure 1:
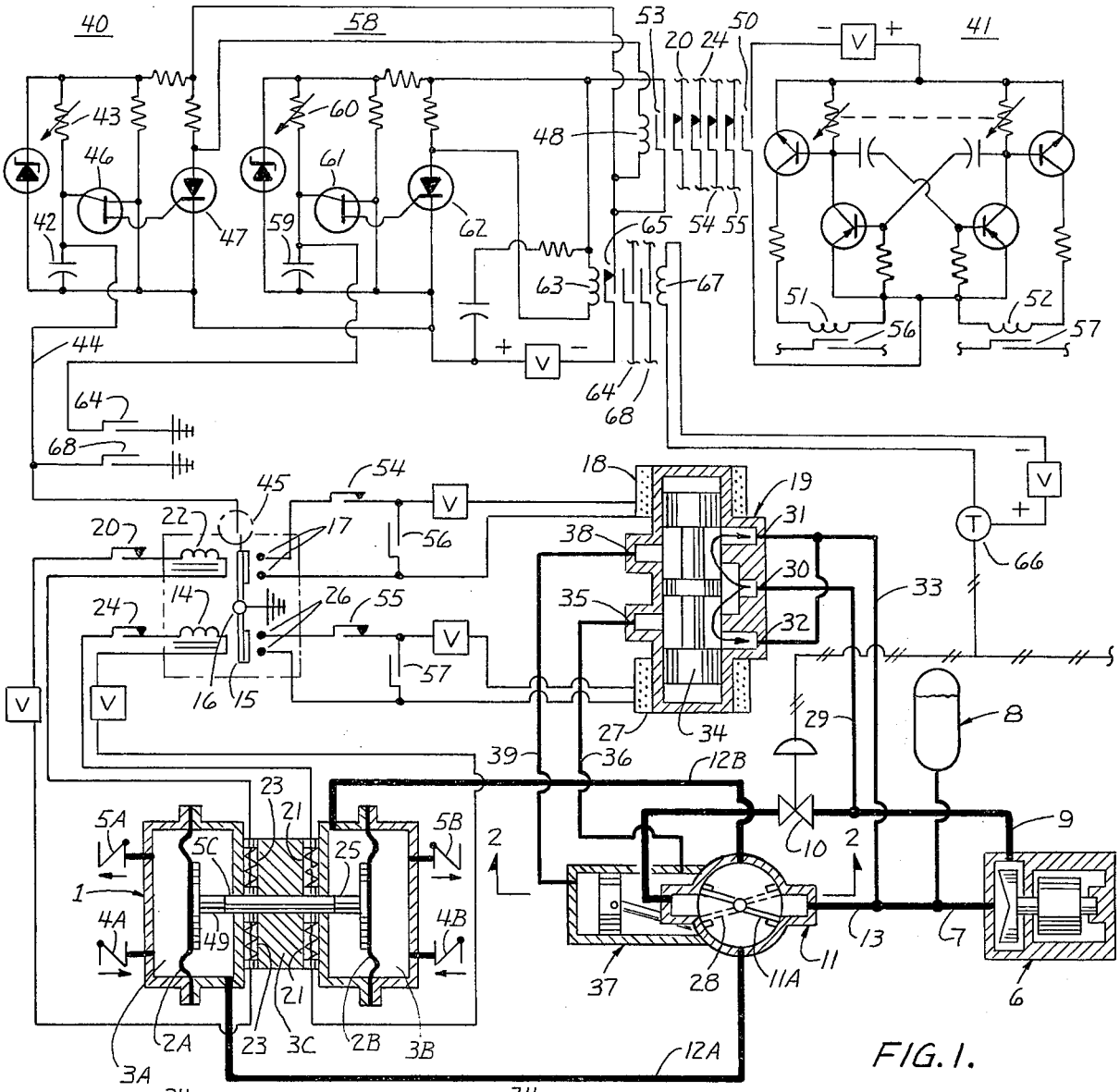
FIG. 1 shows the pump and its control.

The pump has a hermetically sealed casing 1 having diaphragms 2*a*, 2*b* respectively in its pumping chambers 3*a*, 3*b* defined by a center partition 3*c*. The chambers have inlet check valves 4*a*, 4*b* and outlet check valves 5*a*, 5*b*. The diaphragms are connected to each other by a rigid piston rod 5*c* so that when one of the diaphragms is in its suction stroke the other diaphragm is in its pressure or delivery stroke.

The diaphragms are operated by hydraulic liquid pressure obtained from a centrifugal pump 6 having an inlet line 7 connected to a reservoir 8 connected through a throttle valve 10 to a four way valve 11. The valve 11 is shown in the position delivering liquid through line 12*a* to diaphragm 2*a* and delivering return liquid from diaphragm 2*b* through line 12*b* and 13 to the inlet line 7 of the centrifugal pump. In this position diaphragm 2*a* is moving to the left discharging slurry through check valve 5*a* and diaphragm 2*b* is also moving to the left sucking slurry into the chamber 3*b* through inlet check valve 4*b*.

When the diaphragms are moving to the left the iron core electromagnet relay coil 14 is energized and has captured armature 15 which is pivoted at 16 to close the upper end of the armature across contacts 17 in series with solenoid 18 of a four way solenoid pilot valve 19. The coil 14 is energized through a normally closed switch 24 and brushes 21 riding on the rod 5*c*. As shown the iron core electromagnet relay coil 22 which enters a magnetic field attracting armature 15 also energized through brushes 23 which ride on the rod 5*c*. The coil 22 can have no effect upon the armature 15 since the lower end of the armature is too close to the coil 14

When the diaphragms move to the extreme left position finishing the stroke, the circuit through brushes 21 is interrupted by a section 25 of insulating material which is moved between the brushes 21 and the coil 14 is de-energized. Coil 22 is still energized and acts on the upper end of the armature 15 to close contacts 26 and to energize solenoid 27 of the four way solenoid pilot valve 19. Energizing the solenoid 27 causes the vane 11*a* of valve 11 to be shifted to the position shown by dotted lines 28 in which the liquid from the centrifugal pump 6 is connected through line 9 to line 12*b* and the intake of the centrifugal pump is connected through line 13 and line 12*a* to the diaphragm 2*a*. This causes the diaphragm 2*a*, 2*b* to move to the right as shown in FIG. 1 which continues until section 49 of insulating material comes between the brushes 23 and interrupts the circuit to coil 22 and allows coil 14 to again become dominant and close the upper end of armature 15 against contacts 17 and energize the solenoid 18 of the four way valve 19.

The operation of coils 14 and 22 in controlling armature 15 to close either contacts 17 or contacts 26 is based upon the principle that the magnetic forces of the coils can never be precisely balanced and so that even though both coils are energized, one of the coils must always exert a force slightly greater than the other and the coil exerting the greater force will take command and pivot the armature 15 in the direction to close its contacts. As soon as the armature starts to move, the end of the armature 15 associated with the dominant coil comes closer and the other end of armature 15 moves further away from the other coil so that the movement of the armature 15 is always positive and with a snap action. This is true even though the pump is first energized when the parts are in the position shown in FIG. 1 with the diaphragms 2*a*, 2*b*, in mid stroke position and with the armature 15 also in mid position. As soon as the coils are energized the armature 15 will be compelled to rotate from the mid position toward one or the other of coils and cannot remain in the mid position illustrated. From the point of view of the operation of the pump, it does not make any difference which coil is dominant when the pump is first started. After starting, the coils operate sequentially.

Figure 3:
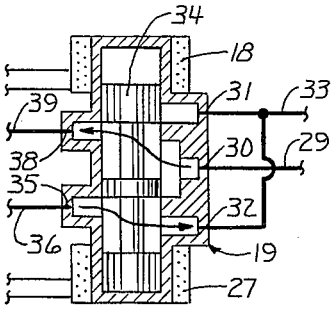
FIGS. 3 and 4 are details of the four way valve which controls the FIG. 2 valve.
Figure 4:
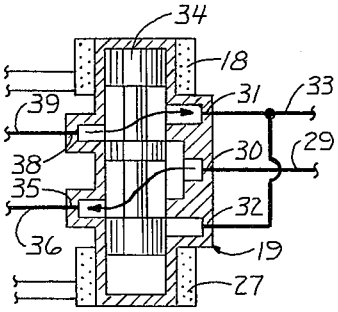
Figure 2:
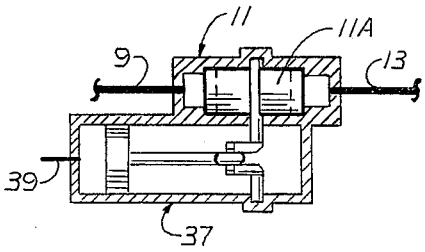
FIG. 2 is a detail of the stroke reversing valve in section on line 2—2 of FIG. 1.

In FIG. 1 the four way pilot valve 19 is shown in the neutral position in which liquid pressure from line 9 is received by the valve from line 29 and fitting 30 and is returned to the pump suction through fittings 31, 32 and line 33. When solenoid 18 is energized the valve spool 34 moves up FIG. 4 connecting liquid pressure fitting 30 to fitting 35 which is connected by line 36 to the hydraulic operator 37 for the valve 11 and at the same time connecting fitting 38 to fitting 31 to return liquid through lines 39 and 33 to the suction inlet for the pump. When solenoid 27 is energized the valve spool is moved downward FIG. 3 connecting the pressure inlet fitting 30 to fitting 38 through line 39 to the operator 37 for the valve 11 and at the same time connecting fitting 35 to fitting 32 to return liquid to the pump suction through line 33.

The parts so far described are adequate when the pump is operating under steady state conditions. However, when the pump has been shut down for some time, slurry may settle out in the pumping chambers and physically block the reciprocation of the pump so that the pump cannot even complete its initial pumping stroke and therefore all pumping is stopped. In order to prevent this, a delay detector 40, is provided which comes into action whenever either pumping chamber is plugged and blocks the pumping action. For example if the diaphragms under normal conditions are reciprocated at one stroke per second, the delay detector might come into action whenever the diaphragm cannot complete its stroke in three seconds. The delay detector circuit would then transfer the control from the coils 14 and 22 to an over ride control such as multivibrator 41.

The delay detector 40 has a capacitor 42 which is charged through resistor 43 and is normally discharged through line 44 and switch 45 which is connected to ground through armature 15 each time the armature changes its position. Under normal conditions when the armature 15 is changing its position once per second the capacitor 42 never charges to a sufficiently high voltage. When the pump fails to complete its stroke within three seconds the voltage on the capacitor 42 becomes high enough to activate unijunction transistor 46 to trigger SCR 47 on and cause current to flow through coil 48. Energizing coil 48 closes normally open switch 50 starting the multivibrator 41 which alternately energizes coils 51 and 52. Energizing coil 48 also closes normally open switch 53 and opens normally closed switches 20, 24 in the circuit of coils 14 and 22 and also opens normally closed switches 54, 55 respectively in circuit with contacts 17 and 26. The closing of switch 50 causes alternate energizing of coil 51 and 52 at a relatively high rate, for example 10 cycles per second. Energizing coil 51 closes normally open switch 56 in circuit with solenoid 18 and energizing coil 52 closes normally open switch 57 in circuit with solenoid 27. The multivibrator 41 accordingly causes the valve 11 to be shifted from the full line 11*a* to the dotted line 28 positions at a high rate (10 cycles per second) and causes liquid under pressure to be alternately transmitted to lines 12*a*, 12*b* causing back and forth motions of the diaphragms 2*a*, 2*b* which tend to break loose any particles of slurry which may have settled out in the pumping chambers. While this vibratory action is effective in loosening the settled particles of slurry, it should not be continued for too long a time. This is accomplished by a "timing out" control circuit 58 which is started in action by the closure of normally open switch 53 at the same time the multivibrator 41 is started in action by the closure of normally open switch 50. The timing out circuit has a capacitor 59 charged through resistor 60. At the end of 10 seconds, the charge on capacitor 59 is high enough to activate unijunction transistor 61 to trigger SCR 62 to temporarily energize coil 63, which opens normally closed switch 65, stopping the flow of current through SCR's 47, 62 and coil 48 which returns pump and control FIG. 1 to normal pumping action. Temporarily energizing coil 63 also closes normally open switches 64, 68 to ground capacitors 42, 59, thus resetting the voltage buildup to zero.

In the event the throttle valve 10 is tied into an external process requiring variable pumping rates a way must be provided to deactivate the delay detector 40, when the external process calls for a pumping rate of zero. An additional coil 67 energized through normally open switch 66 will open switch 65 thereby keeping capacitor 42 discharged and delay detector 40 nonoperative.

I claim:

1. A reciprocating pump having first and second pumping chambers each having an inlet and an outlet for fluid to be pumped, first and second motor chambers each having inlet and an outlet for driving fluid, a first diaphragm common to the first pumping and motor chambers, a second diaphragm common to the second pumping and motor chambers, means for controlling the supply of driving fluid to the motor chambers, said control means having an armature movable to a first position for controlling the supply of driving fluid to said first diaphragm for its pumping stroke and to a second position for controlling the supply of fluid to the second diaphragm for its pumping stroke, a first electromagnetic coil for moving the armature to said first position, a second electromagnetic coil for moving said armature to said second position, each coil when energized being strong enough to hold the armature in its position when the other coil is simultaneously energized, and circuit means for energizing both coils during the pumping stroke of each diaphragm and for de-energizing the coil associated with each diaphragm at the end of its pumping stroke to initiate the pumping stroke of the other diaphragm.

2. The pump of claim 1 in which the pump has a sealed casing with a center partition dividing the casing into first and second parts, the first part containing the first pumping chamber, first diaphragm and first motor chamber, the second part containing the second pumping chamber, second diaphragm and second motor chamber, said diaphragms being tied together by a rod slidable through through the partition.

3. The pump of claim 2 in which the coils are energized through brushes on said rod and are de-energized by insulating sections interposed between said brushes and said rod.

4. A fluid driven reciprocating pump having first and second pumping chambers each having an inlet and an outlet for fluid to be pumped, first and second motor chambers each having inlet and an outlet for driving fluid, a first diaphragm common to the first pumping and motor chambers, a second diaphragm common to the second pumping and motor chambers, a first control means for controlling the supply of driving fluid alternately to said first and second pumping chambers at a rate which allows each diaphragm to complete its pumping stroke within a predetermined time, and a second control means responsive to an incomplete stroke of a diaphragm within said predetermined time for controlling the supply of driving fluid alternately to said first and second pumping chambers at a much higher rate to produce vibratory impulses for jarring loose obstructions to completion of said incomplete stroke.

5. The pump of claim 4 in which the first control means comprises an armature movable to a first position for controlling the supply of driving fluid to said first diaphragm for its pumping stroke and to a second position for controlling the supply of driving fluid to the second diaphragm for its pumping stroke, a first electromagnetic coil for moving the armature to said first position, a second electromagnetic coil for moving said armature to said second position, each coil when energized being strong enough to hold the armature in its position when the other coil is simultaneously energized, and circuit means for energizing both coils during the pumping stroke of each diaphragm and for de-energizing the coil associated with each diaphragm at the end of its pumping stroke to initiate the pumping stroke of the other diaphragm.

6. The pump of claim 4 in which the second control means responds to an incomplete stroke comprises timing means started at the beginning of a pumping stroke and reset at the end of the stroke for supplying fluid alternately to said first and second pumping chambers at said much higher rate if the stroke is not completed within said predetermined time.

* * * * *